US005826652A

United States Patent [19]

Tapp

[11] Patent Number: 5,826,652

[45] Date of Patent: Oct. 27, 1998

[54] HYDRAULIC SETTING TOOL

[75] Inventor: William T. Tapp, Yorktown, Tex.

[73] Assignee: Baker Hughes Incorporated, Houston, Tex.

[21] Appl. No.: 826,840

[22] Filed: Apr. 8, 1997

[51] Int. Cl.[6] ..... E21B 23/06; E21B 34/12

[52] U.S. Cl. ..... 166/120; 166/123; 166/128; 166/334.4

[58] Field of Search ..... 166/120, 123, 166/124, 126, 128, 133, 142, 152, 188, 334.4, 240

[56] References Cited

U.S. PATENT DOCUMENTS

| | | | |
|---|---|---|---|
| 2,624,412 | 1/1953 | Ragan | 166/120 |
| 2,703,623 | 3/1955 | Baker | 166/124 |
| 3,050,128 | 8/1962 | Brown | 166/120 |
| 3,306,363 | 2/1967 | McZilkey, Jr. . | |
| 3,306,366 | 2/1967 | Muse . | |
| 3,378,078 | 4/1968 | Current . | |
| 3,387,660 | 6/1968 | Berryman . | |
| 3,556,220 | 1/1971 | Schwegman | 166/120 |
| 4,237,979 | 12/1980 | Weise . | |
| 4,349,071 | 9/1982 | Fish . | |
| 4,436,149 | 3/1984 | Edwards | 166/120 |
| 4,441,552 | 4/1984 | Hamman | 166/133 |
| 4,688,634 | 8/1987 | Lustig et al. . | |
| 4,828,037 | 5/1989 | Lindsey et al. . | |
| 4,893,678 | 1/1990 | Stokley et al. . | |
| 4,972,908 | 11/1990 | Braddick . | |
| 5,044,441 | 9/1991 | Rubbo et al. . | |
| 5,095,978 | 3/1992 | Akkerman et al. . | |
| 5,366,010 | 11/1994 | Zwart . | |
| 5,404,956 | 4/1995 | Bohlen et al. . | |
| 5,579,840 | 12/1996 | Sauer . | |

OTHER PUBLICATIONS

Baker Packers, A Baker Oil Tools Company Catalog, Permanent Packer Systems, 3 pages, 1982.

Baker Information Sheet, Remedial–Stimulation Drillable Retainers & Bridge Plugs, Baker Mercury Cement Retainers and Wireline Casing Bridge Plugs, 1 page, date unknown.

Baker Information Sheet, Remedial–Stimulation Drillable Retainers & Bridge Plugs, Baker Model "K" Cement Retainers (and Casing Bridge Plugs), 1 page, date unknown.

Baker Technical Sheet, Remedial and Stimulation Technical Unit, Model "CT" Hydraulic Setting Tool, 1 page, Mar. 1996.

*Primary Examiner*—Hoang C. Dang

*Attorney, Agent, or Firm*—Rosenblatt & Redano P.C.

[57] ABSTRACT

A packer is disclosed having a setting piston mounted on the body thereof. The packer is hydraulically set prior to treating or cementing. The packer has a sliding sleeve valve which is open during run-in. After the packer has set, the setting tool is released from the valve. The valve may then be operated through manipulation of the tubing string. The tubing string can be disengaged and reengaged into the packer body to determine if the valve has closed by measuring the pressure conditions at the surface.

17 Claims, 7 Drawing Sheets

HYDRAULIC SETTING TOOL

FIELD OF THE INVENTION

The field of this invention relates to setting tools, particularly those adapted to be used with hydraulically set packers, with the setting tool further interacting with a downhole valve for operation thereof.

BACKGROUND OF THE INVENTION

Packers have been run in on coiled tubing or rigid tubing with the setting tool having one or more pistons to initiate the setting of the packer. These setting tools were subject to damage and/or contamination by well-treating fluids and cement used in remedial and stimulation operations.

U.S. Pat. No. 5,404,956 illustrates the use of a hydraulic setting tool with a piston movement to actuate a packer which also had provisions for opening and closing of the valve after setting the packer. Other running and setting tools used for packers are illustrated in U.S. Pat. Nos. 4,688,634; 4,972,908; 5,095,978; 5,366,010; 3,306,363; 3,306,366; 3,378,078; and 4,349,071. Hydraulic Setting Tool Model CT has been offered by Baker Oil Tools and allows for running in and setting hydraulically on coiled tubing to set a retainer or plug.

U.S. Pat. No. 4,237,979 illustrates a valve assembly mounted with a setting tool for hydraulically actuated well packers. U.S. Pat. No. 3,387,660 illustrates the use of a pressure balanced, slidably mounted sleeve in conjunction with a well packer.

One of the objects of the invention is to provide a well packer apparatus having a passage and a valve for controlling fluid flow through the passage. The valve is selectively shiftable positively between the opened and closed positions and is pressure balanced. The valve is responsive to movement through a strain imposed on the running-in string and locked in a closed position against inadvertent shifting to the open position. Another objective is to be able to deliver a packer to the desired location and disconnect by longitudinal movement of the conveying tubing without rotation.

Another objective is to allow the conveying tubing to be connected and disconnected to the packer for manipulation of the valve as many times as required. Another objective of the invention is to allow verification at the surface that the valve is closed in the absence of valve leakage by providing a configuration that will not release on application of pressure buildup to allow the valve which is pressure balanced to have its position confirmed at the surface. Another objective of the invention is to provide a configuration where well-treating fluids or cement will not damage the actuating components.

SUMMARY OF THE INVENTION

A packer is disclosed having a setting piston mounted on the body thereof. The packer is hydraulically set prior to treating or cementing. The packer has a sliding sleeve valve which is open during run-in. After the packer has set, the setting tool is released from the valve. The valve may then be operated through manipulation of the tubing string. The tubing string can be disengaged and reengaged into the packer body to determine if the valve has closed by measuring the pressure conditions at the surface.

DETAILED DESCRIPTION OF THE DRAWINGS

Figure 1A:
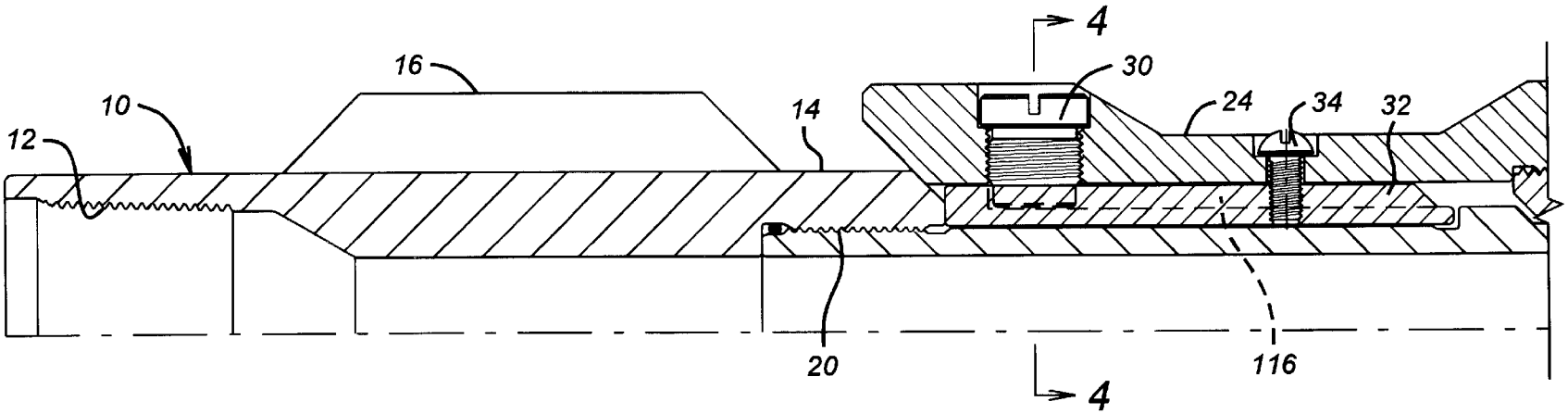
Figure 1B:
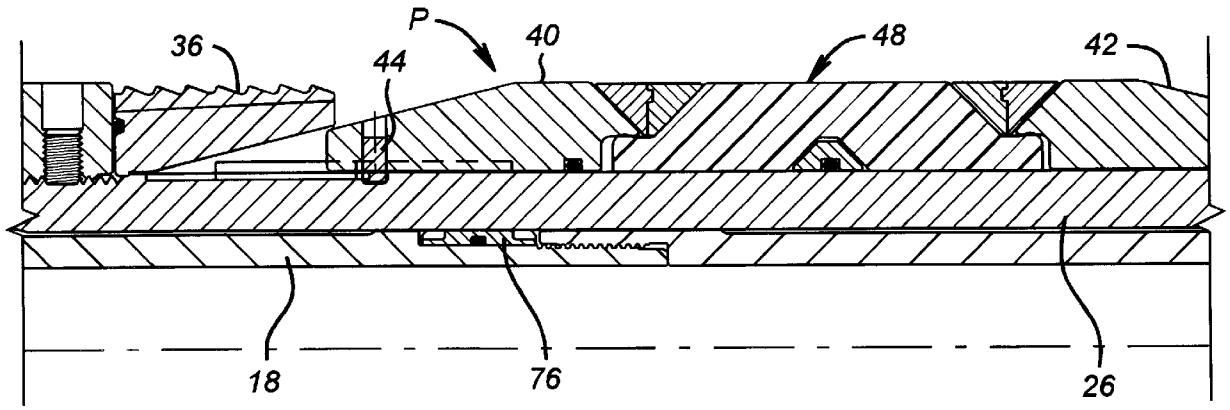
Figure 1C:
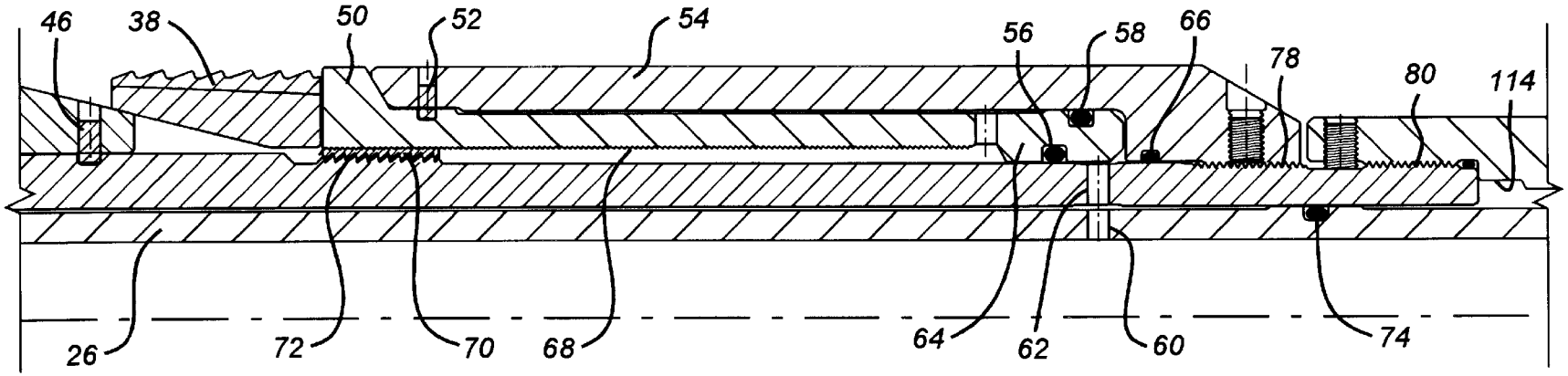

FIGS. 1*a–d* are sectional elevational views of the apparatus in the run-in condition with the valve open.

FIGS. 2*a–d* are the views of the apparatus shown in FIGS. 1*a–d* with the packer in the set position and the valve closed.

FIGS. 3*a–d* illustrate the set position of the packer with the setting tool removed.

FIGS. 4*a–d* are a view along lines 4—4 of FIG. 1 showing four positions of pin 30 during the setting tool operation.

DETAILED DESCRIPTION OF THE PREFERRED EMBODIMENT

The setting tool 10 is connected to tubing string at thread 12. The tubing string is not shown; it may be rigid or coiled tubing. The setting tool 10 has a top sub 14, with one or more spacers or centralizers 16 disposed about its periphery. Setting tool 10 has a body 18 which begins at thread 20 and continues to lower end 22 (see FIG. 1*d*).

The packer P has a top sub 24 connected to a body 26, which in turn is connected to bottom sub 28. Top sub 24 has a pin 30 extending into a ring 32, having a plurality of slotted passageways 116 as shown in FIG. 4. Those skilled in the art will appreciate that pin 30 rides in the passageways of ring 32, as shown in FIG. 4, for selective relative movements between the packer P and the setting tool 10. A shear screw 34 holds the top sub 24 to the setting tool 10 by virtue of its extension into ring 32.

The packer P has an upper slip 36 and a lower slip 38. Upper slip 36 rides on cone 40, while lower slip 38 rides on cone 42. Cone 40 is secured to body 26 by shear pin 44, while cone 42 is secured to body 26 by shear pin 46. Between cones 40 and 42 is a sealing element 48, which can be of a variety of known designs.

Figure 2A:
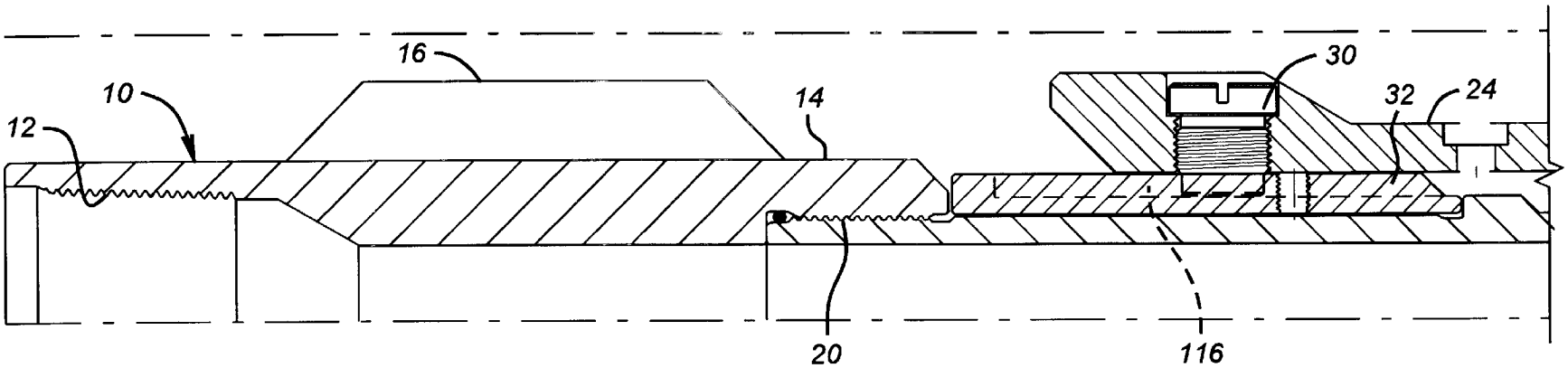
Figure 2B:
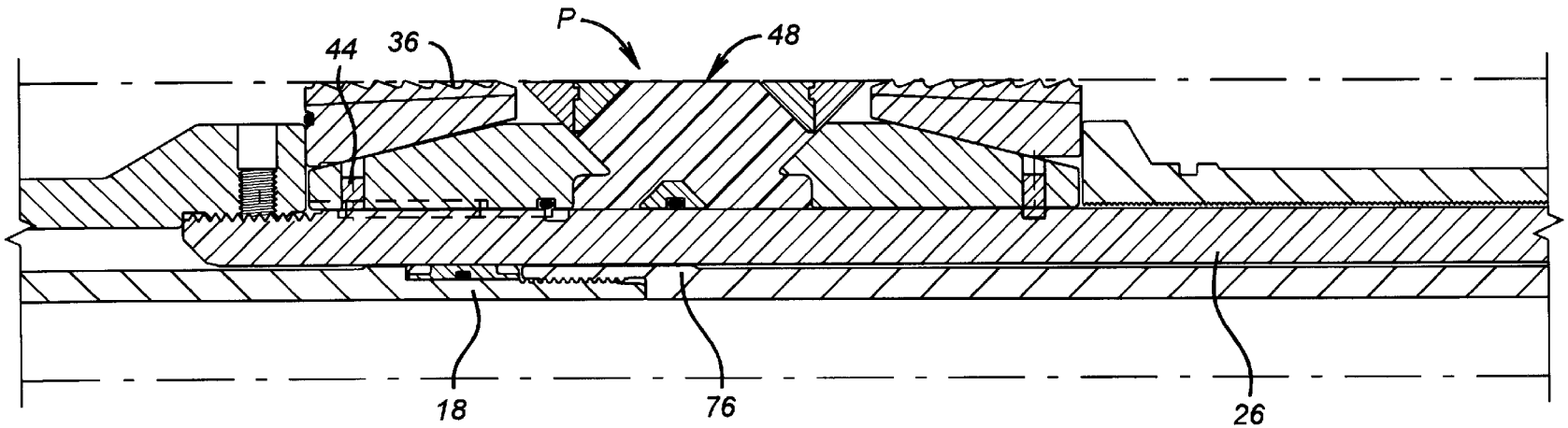
Figure 2C:
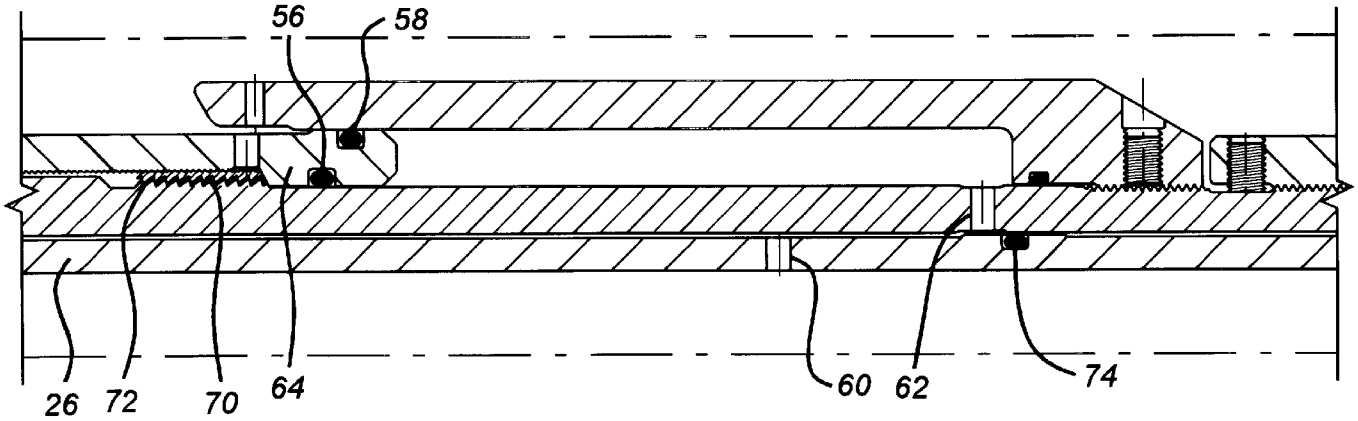

A piston 50 is initially retained by a shear pin 52 to cylinder 54. Piston 50 has seals 56 and 58 mounted, respectively, against body 26 and cylinder 54. Body 18 of setting tool 10 has a port 60, which aligns with a port 62 in body 26 of the packer P. In running position, the lower end 64 of piston 50 covers the port 62. Seal 66 is located below port 62 and seals between cylinder 54 and body 26. Piston 50 has a series of teeth 68 which engage a lock ring 70, which is in turn secured to teeth 72 in body 26. Piston 50 is able to move uphole as shown in FIG. 2*c,* and lock ring 70 retains the set position.

Sealing between body 18 of setting tool 10 and body 26 of the packer P are O-ring 74 below port 60 and seal assembly 76 above port 60. Cylinder 54 is secured to body 26 at thread 78. Bottom sub 28 is secured to body 26 at thread 80. Lower end 22 of body 18 of setting tool 10 further includes a ring 82, which has on it a seat 84. Seat 84 accepts a ball 86, which is dropped from the surface for contact with seat 84, so that applied pressure passes through the ports 60 and 62 to actuate piston 50. Other techniques of building up pressure in passages 60 and 62, such as an orifice which relies on backpressure, are all within the scope of the invention.

Figure 2D:
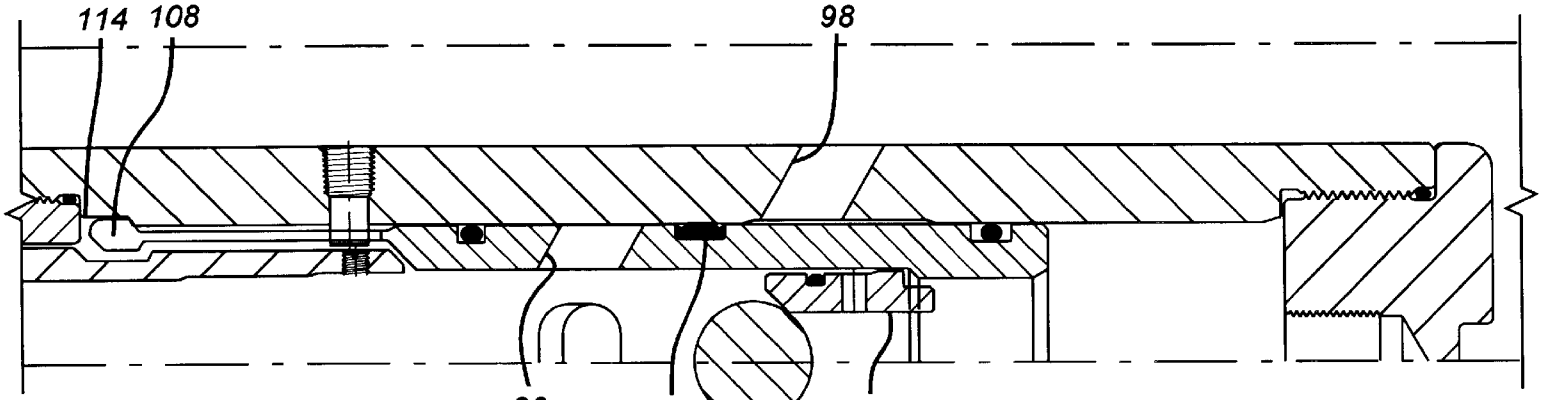
Figure 3A:
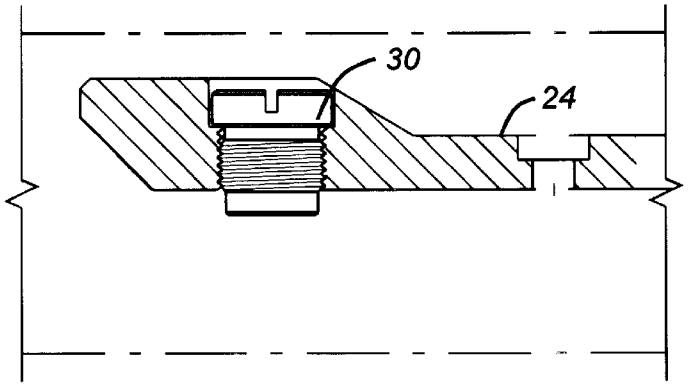
Figure 3B:
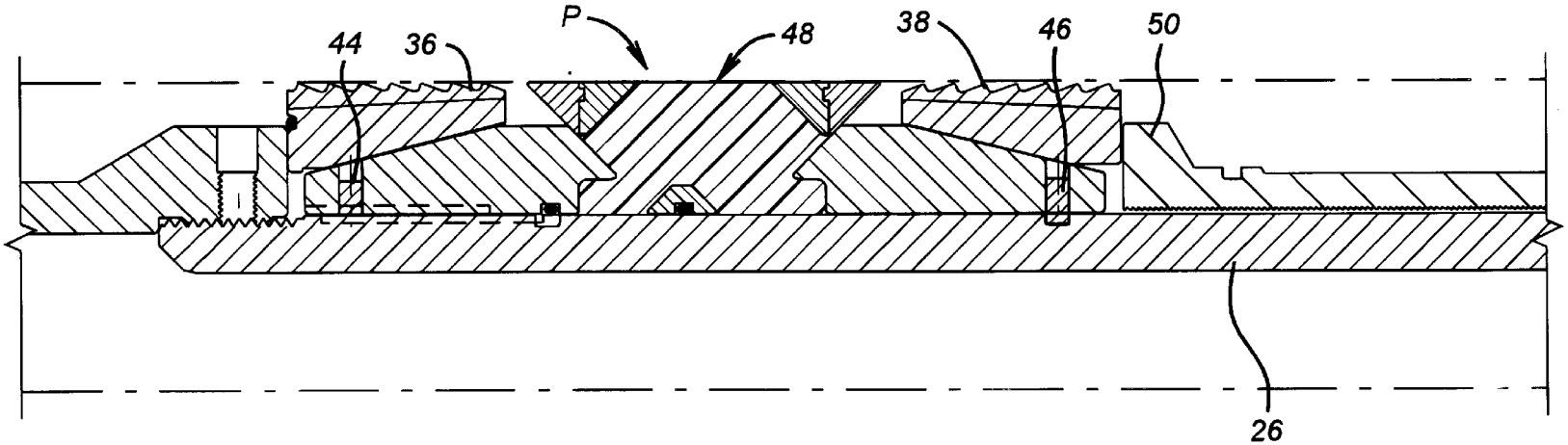
Figure 3C:
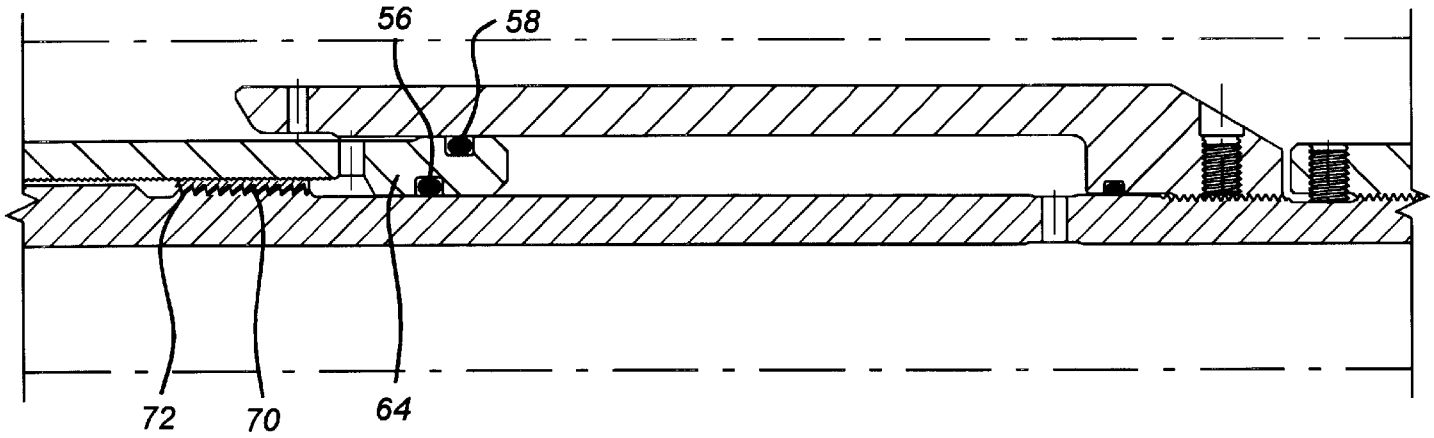
Figure 3D:
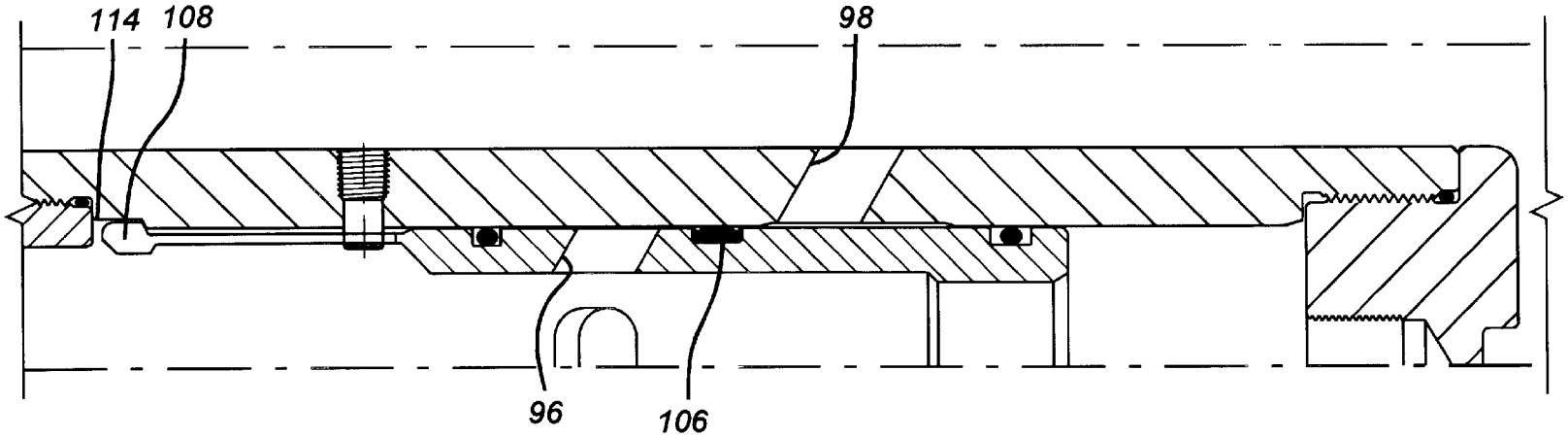

A seal 88 seals between ring 82 and lower end 22. A shear pin 90 secures ring 82 to lower end 22 until a predetermined force is exceeded on ball 86 when seated against seat 84, which makes ring 82 break shear pin 90, as illustrated in FIG. 2*d*. Ring 82 shifts downwardly until it is caught by shoulder 92. The valve V comprises a tubular sleeve 94 which has a port or ports 96, which during run-in are aligned with port or ports 98 in bottom sub 28. O-ring seals 100 and 102 seal between sleeve 94 and bottom sub 28, basically acting as debris barriers. Bottom sub 28 has an undercut 104. Sleeve 94 has a bonded seal 106 which spans undercut 104 and during run-in is disposed below ports 98. Ultimately, bonded seal 106 crosses across ports 98 to the position shown in FIG. 2*d*. Bonded seal 106 and undercut 104 are used to avoid any danger of extrusion or ripping of another type of seal that has to move across ports 98 as sleeve 94 shifts.

Figure 1D:
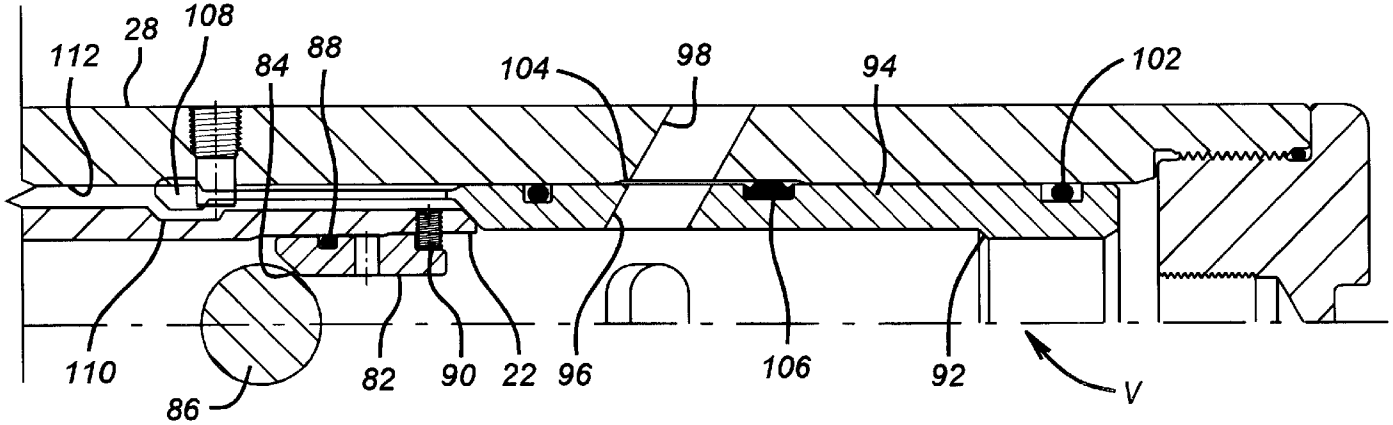

Sleeve 94 terminates in one or more collets 108, which during run-in are aligned opposite a groove 110, thus trapping collets 108 between groove 110 and surface 112 on bottom sub 28, as shown in FIG. 1*d*. Release of the setting tool 10 is possible when the inwardly flexed collet heads 108 are pulled upwardly sufficiently to clear surface 112 and expand into groove 114. This position is shown in FIG. 2*d*. When collet heads 108 are in groove 114, the valve is released from the setting tool 10.

The significant portions of the apparatus of the present invention having been described, a detailed operation will now be discussed. The packer P is run-in with setting tool 10, as shown in FIGS. 1*a–d*. At that time, shear pin 34 holds pin 30, which is part of top sub 24, in a stationary position with respect to ring 32. It will be recalled, as shown in FIG. 4, that ring 32 has a plurality of passages 116. This configuration is commonly referred to in the industry as a J-slot mechanism or a reciprocating J assembly, because the movement of pin 30 in passages 116 resembles the shape of the letter "J." In essence, the longitudinal movement of the setting tool 10 is converted to a rotational movement. This connection is facilitated in that passages 116 have a repeating design, with exit points or entrance points 118 where connection or disconnection can occur. There is also a latch point or points 120 where a connection can be maintained. Thus, during run-in, pin 30 is at a latch point 120, as shown in FIG. 4.

Shear pin 34 engages ring 32 to prevent disconnection during run-in. When the packer P is set at the proper depth, a ball 86 is dropped on seat 84 and pressure is built up. The pressure build-up extends into passages 60 and 62 and ultimately begins to move piston 50. Initial movement of piston 50 breaks shear pin 52. Shear pin 46 then breaks, which allows cone 42 to move, causing the sealing element 48 to be compressed and move lower slip 38 over cone 42, placing both the sealing element 48 and lower slip 38 into contact with the wellbore. Applied pressure through ports 60 and 62 will also act upon the area defined by the bore of cylinder 50 and body 26, causing these units to move in the opposite direction, pulling the top sub 24 downward to shear pin 44 and moving upper slip 36 over upper cone 40 into contact with the wellbore. The packer P is now set. Further elevation of pressure on ball 86, beyond achieving set of the packer P, breaks shear pin 90 which secures ring 82. Ring 82 and ball 86 move downwardly until they reach shoulder 92, as shown in FIG. 2*d*.

As previously stated, the valve V is in the opened position for run-in, with ports 96 aligned with ports 98. This allows the running in string to fill with fluid as the packer is being run into the wellbore and circulation of treating fluids before ball 86 is dropped onto seat 84. After setting the packer P and displacing the ring 82 with ball 86, it is desirable to close the valve V. This is accomplished by a pick-up force on the setting tool 10, which advances pin 30 through passageways 116 on ring 32. Thus, the setting tool 10 can be moved upwardly taking with it collet heads 108 until collet heads 108 reach groove 114. At this point, the setting tool 10 is prevented from further upward movement by the J-slot on ring 32. However, translating collet heads 108 from the initial position shown in FIG. 1*d* to the final position shown in FIG. 2*d* results in moving sleeve 94 upwardly so that ports 96 are now misaligned with ports 98, with seal 106 in between. As shown in FIG. 2*d*, the valve V is now closed and the setting tool 10 is removable, as shown in FIG. 3. With the setting tool in this upward position, the setting tool 10 and attached running in string, as well as valve seals 106 and 102, may be tested for pressure integrity. At this point, application of set-down force on the setting tool 10 will advance pins 30 through passageway 116, again moving valve V downward into an open position so that fluid may be passed from the running in string through valve V and thus below the packed off packer assembly P. Pick-up force on the setting tool 10 at this point will advance pins 30 through passage 118 on ring 32. At this point, the setting tool 10 can be moved clear of collet heads 108. The stroke of piston 50, as previously stated, is retained by lock ring 72.

The design illustrated for the packer P is a non-retrievable design. By use of the "J" connection, as illustrated between pin 30 and slot arrangement 116, the setting tool 10 can be disconnected or reconnected from the packer P for opening and closing the valve V as required. When reconnecting, collet heads 108 are in the position shown in FIG. 2*d*. Manipulation of the setting tool 10 from the surface traps collet heads 108 within groove 110 to force them down from the position shown in FIG. 2*d* back to the position shown in FIG. 1*d* to reopen the valve V.

The apparatus as described can accommodate casing having a given size but with a variety of wall thicknesses.

The apparatus of the present invention has several advantages over applications where a setting tool with actuating pistons is used to set a given packer. In those applications, the setting tool is intended to be reused frequently and is fairly costly to construct. In those designs with the piston or pistons on the setting tool after the packer is set, the annulus is tested from the surface by pressurization. This pressurization can stroke the piston or pistons in the setting tool, which is still in the wellbore at this time. Thereafter, in the prior designs, the setting tool is removed from the packer and the cement is spotted prior to stabbing back into the packer. The spotting of the cement raises the tubing pressure above the annulus pressure, which again moves a piston or pistons in the setting tool in the presence of cement. This tends to foul the piston area in such setting tools.

The apparatus of the present invention addresses this issue by putting the piston in the packer body. Before the cement gets near the piston, it has already served its useful function in setting the packer. Thus, particularly in an application involving a nonretrievable packer or plug, a setting tool such as that described above for the present invention is simple to make and is not prone to fouling from treatment fluids or cement.

In using the apparatus of the present invention after the packer P is set, the annulus is pressurized. During this test, weight is set down on the setting tool 10. After concluding that the packer P has been adequately set, the annulus pressure is removed and a pick-up force is applied to the setting tool 10 which closes the valve V and allows the setting tool 10 to release from the packer P. At that point, the cement is spotted as is traditionally done and thereafter the setting tool 10 is reinserted into the packer P for pumping cement through the packer P. Thus, the setting tool is economical to make and the piston is provided with the packer so that the setting tool can be reliably reused. A simple system for shifting the valve is provided to allow access to it and a positive system to know its position. Rotation is not required as the J-slot system converts the longitudinal force into a combined movement that releases the tool and closes the valve or locks the setting tool to the valve where it is in the open position. The tool is simple and can be simply prepared for subsequent service by replacement of seal 88 and, if necessary, seals 74 and 76. There are no moving parts to the setting tool 10 in order to set the packer P. There are no pistons which can have their seals fouled with cement, which was a problem of prior tools with pistons and seals exposed to cementing operations.

Figure 4A:
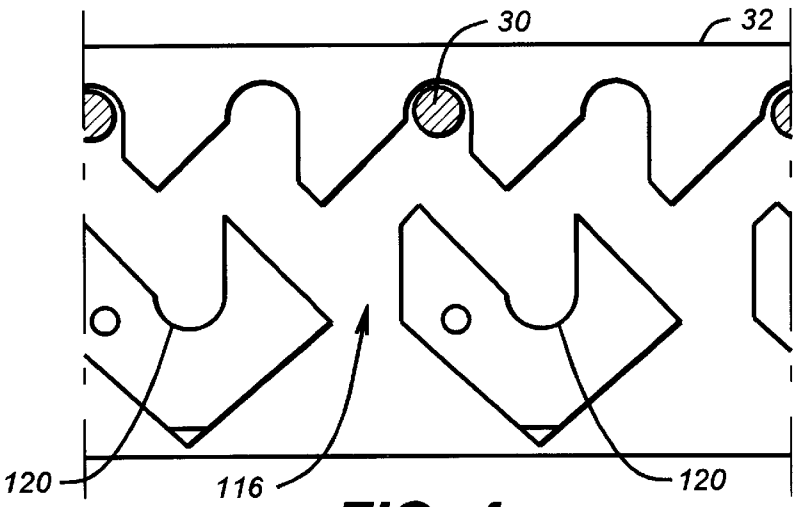

FIG. 4*a* shows the position of the pin 30 contained in the top sub 24 of the packer P in relation to the control sleeve 116 J-slot and the shear screws 34 inserted through the top sub 24 and threaded into the control sleeve 32 as these parts would be arranged when the tool is prepared for running into the wellbore. To achieve this position, the running tool is inserted into the bore of the packer a sufficient distance so that the pin 30 contacts the upper limit of the control slot at position 1 in passageway 116. When the pin 30 is at position 1, port 60 in the running tool will be in alignment with port 62 in the packer body 26, and the lower end of the running tool 22 will have pushed the valve V downward such that port 96 is aligned with port 98 in the bottom sub 28. With the parts in this position, the running tool is secured to the packer device and fluid may pass through ports 98 and 96, allowing the running in string to fill from the bottom while the tools are being lowered into the wellbore and also allow free circulation of fluids through the work string, and the packer assembly into the wellbore below the packer and up the annular area between the work string and the wellbore. This is also the tool position when the setting ball 86 is seated on the ball seat 84 and pressure is applied through port 60 and 62 to initiate setting of the packer P.

Figure 4B:
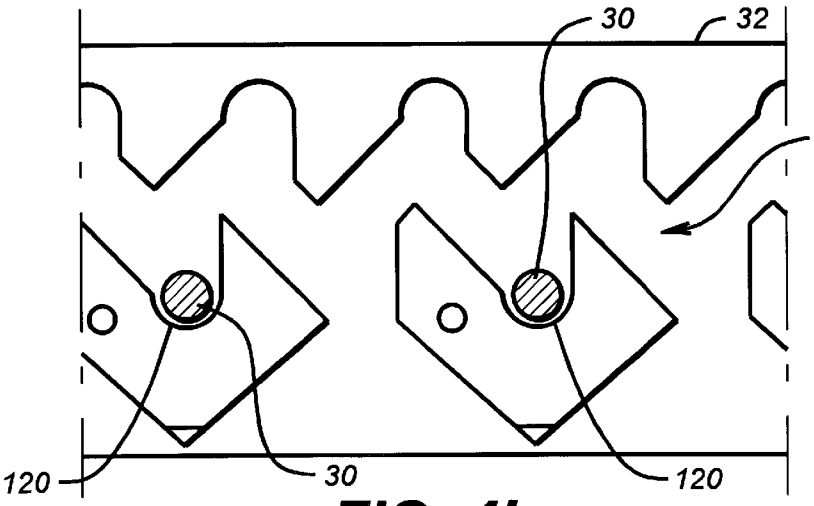

FIG. 4*b* shows the position of the pin 30 after the packer has been set by application of fluid pressure and tension has been pulled on the running tool to shear the shear screws 34, allowing limited upward movement of the control sleeve 32. When the running tool is raised from position 1 to position 2, pin 30 causes control sleeve 32 to rotate around body 18 of the running tool until upward movement is stopped by pin 30 contacting position 2 in J-slot 116. With the running tool in this upward position, the valve V is placed in a closed condition with seal 108 located above port 98 as shown in FIG. 2*d*. In this position, pressure may be applied through the running string and running tool to confirm the pressure integrity of these members and confirm the proper closure of the valve V. In addition, tension may be applied by pulling on the work string to confirm that the packer assembly is secured to the wellbore by the upper packer slips 36.

Figure 4C:
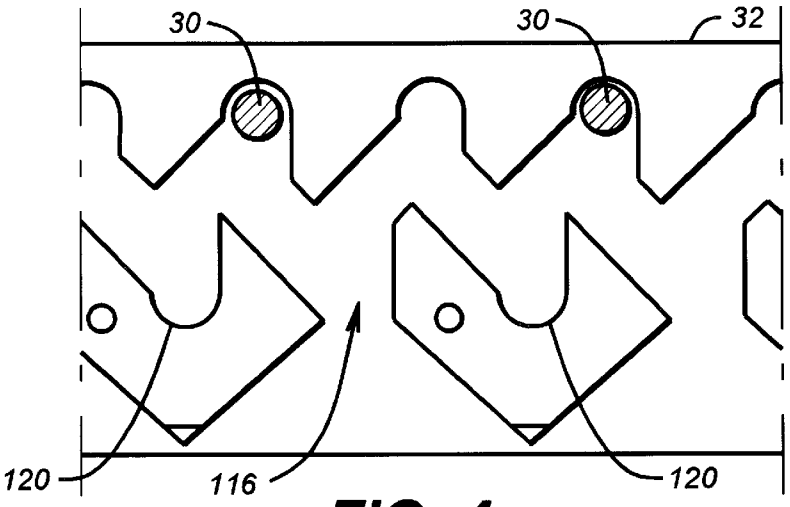

FIG. 4*c* shows the position of the pin 30 when the running in string and running tool are moved downward from the anchored position 2. Downward movement will cause the control sleeve 32 to again rotate about body 18 of the running tool until pin 30 is located at position 3 in the J-slot. The downward movement of the setting tool will again cause lower end 22 to contact the internal shoulder in the valve V, pushing the valve down to align ports 96 and 98. In this position, fluid pumped through the running tool and the valve V will exit through the aligned ports 96 and 98. The set and packed-off packer isolates the annular area above the tool from fluid pumped through the open valve V to that area of the wellbore below the tool.

Figure 4D:
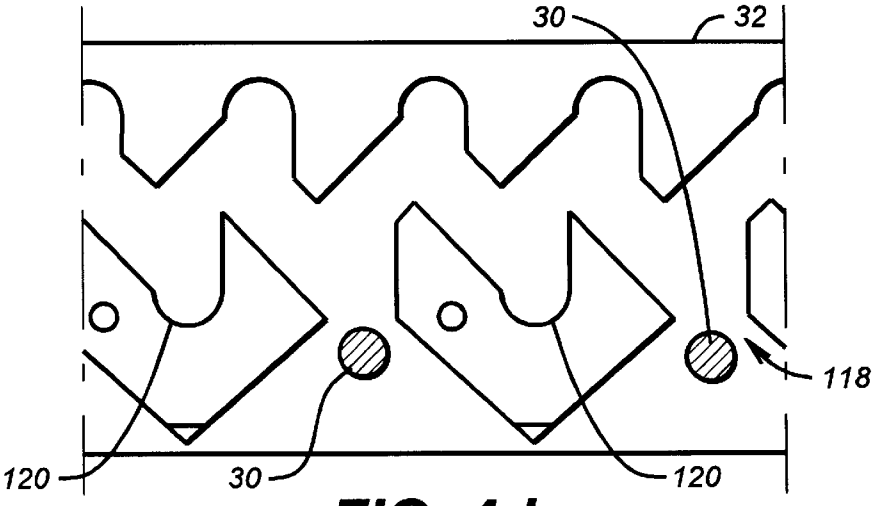

FIG. 4*d* shows the position of the pin 30 when the running string and running tool are moved upward from position 3 to position 4. Upward movement will cause the control sleeve 32 to again rotate about the body 18 and the pin will align with the entrance exit slot 118 in the control sleeve 32. The running tool may be removed from the packer P by continued upward movement.

The running tool may be reinserted into the packer P by lowering the running tool, which will reposition the pin at position 1 as shown in FIG. 4*a* and opening the valve V; however, the shear screws will not be reattached. The sequence of upward and downward movements will follow as described above; that is, from position 1, move upward to position 2 to close the valve V and anchor the running tool to the packer P, downward to position 3 to open the valve, and upward to position 4 to close the valve and exit the tool. This sequence may be repeated as many times as required to control fluid movement from the running in string to that area below the packer or the annular area above the packer.

The normal use sequence will be as follows:

1. Insert the running tool into the packer until the running tool top sub 14 is shouldered against the packer top sub 24. Install shear screws 34.
2. Run tools into the wellbore to the desired setting depth.
3. Insert setting ball 86 into top end of work string and circulate the setting ball 86 to ball seat 84.
4. Apply pressure to the running in string to initiate and achieve pack-off of the packing elements and secure the slips to the wellbore. Bleed off pressure from work string.
5. Apply pressure to the well annular area to confirm that the sealing element 48 is in sealing engagement with the wellbore and the lower slips 38 will support the packer assembly and annular pressure. Bleed off annular pressure.
6. Apply up-strain to the running tool to shear the shear screws 34 and move to position 2 and close valve V. Pressure-test the running in string and the closed valve for pressure integrity. Note the setting ball 86 and the ball seat 82 are retained in the original running position an d cannot be sheared out in position 2 due to trapped fluid between the closed valve and the ball seat.
7. Lower the setting tool to position 3 and again apply pressure to the work string sufficient to shear screws 22, retaining ball seat 82. When the ball seat has been sheared, fluid may be injected below the set packer into open perforations or holes in the well casing wall.
8. Raise the work string from position 3 to position 4 and remove the running tool from the packer bore. With the running tool above the packer, fluid may be circulated down the running in string, through the running tool, and up the running string to wellbore annular area above the packer. In this position, treating fluid such as cement may be placed near the lower end of the running in string.
9. Lower the running tool back into the bore of the packer, placing the running tool in position 1, and inject the treating fluid through the valve below the packer.
10. To release from the packer, it is now necessary to raise the running tool to position 2, lower to position 3, and again raise to position 4.

The foregoing disclosure and description of the invention are illustrative and explanatory thereof, and various changes in the size, shape and materials, as well as in the details of the illustrated construction, may be made without departing from the spirit of the invention.

It is claimed:

1. A packer-setting assembly, comprising:

a packer having a body which further comprises slips and a sealing element and a setting mechanism;

a setting tool selectively insertable into said packer body for transmission of an hydraulic force therethrough to actuate said setting mechanism on said packer body;

said packer body comprises a valve;

said setting tool is connected to said packer body by a J-slot assembly wherein in a first position, said setting tool is attached to said packer body with said valve in one position;

whereupon manipulation of said setting tool moves said valve into another position and releases said setting tool from said packer body.

2. The assembly of claim 1, wherein:

said setting tool is selectively secured to said valve for movement thereof between a closed and open position;

said valve is open with said setting tool latched to said packer body and said valve, and said valve moves toward a closed position as said setting tool is longitudinally manipulated to release from said packer body and said valve.

3. The assembly of claim 2, wherein:

said packer body comprises an actuating piston movable by hydraulic pressure applied through said setting tool;

said setting tool comprises a ball seat and a lateral port in fluid communication with a lateral port on said packer body leading to said piston for selective actuation thereof with fluid pressure.

4. The assembly of claim 3, wherein:

said ball seat is movable upon application of a predetermined pressure to it to signal at the surface by virtue of a pressure drop that said piston has been actuated to set said packer.

5. The assembly of claim 1, wherein:

said setting tool comprises a tubular structure insertable into said packer body with a seat adjacent the lower end thereof and a lateral opening;

said setting mechanism on said packer body comprising an actuating piston, said lateral opening in flow communication with said piston to transmit pressure generated in said setting tool on said seat when said seat is covered in order to move said piston.

6. The assembly of claim 5, wherein:

said seat is covered by an object dropped or pumped into said setting tool.

7. The assembly of claim 1, wherein:

said setting tool has no parts which are required to move to actuate said setting mechanism.

8. The assembly of claim 7, wherein:

said packer body further comprises a valve member;

said setting tool is engaged to said packer body and said valve member when said valve is in a first position and said setting tool selectively releases from said packer body and said valve member after having shifted said valve member to a second position.

9. The assembly of claim 8 wherein:

said valve member comprises at least one collet trapped against said setting tool when said valve member is in an open position;

whereupon manipulation of said setting tool, said collet, after tandem movement with said setting tool sufficient to close said valve member, is released from said setting tool to facilitate removal of said setting tool from said packer body.

10. The assembly of claim 9, wherein:

said setting tool may be reengaged to said packer body for subsequent operation of said valve after actuation of said setting mechanism.

11. The assembly of claim 10, wherein:

said setting mechanism comprises a piston on said packer body;

said setting tool has a seat and a lateral port, said seat subject to being covered by an object inserted into said setting tool, whereupon pressure build-up in said setting tool moves said piston in said packer body to set said slips and said sealing element.

12. The assembly of claim 11, wherein:

said seat is slidably mounted to move when a predetermined pressure is applied to an object engaged to said seat;

whereupon the built-up pressure to move said piston is relieved by movement of said seat by allowing flow through said open valve member.

13. The assembly of claim 7, wherein:

said setting tool is further selectively engaged to a valve member;

whereupon to release said setting tool from said packer body, said valve member is shifted to a position where it releases from said setting tool.

14. The assembly of claim 13, wherein:

said setting tool is reengageable to said packer body and valve member for subsequent operation of said valve member with said slips and sealing element set on said packer.

15. The assembly of claim 7, wherein:

said setting tool comprises external seals for sealing between said packer body and said setting tool, said external seals are readily accessible for renewal with said setting tool removed from the packer body;

said setting tool further comprises an internal seat mounted with a seal against said setting tool and held in place by a frangible member, whereupon retrieval of said setting tool after setting said packer, said seal and said seat can be easily renewed with a new frangible member, and said setting tool is reusable to set another packer.

16. The assembly of claim 1, wherein:

said setting mechanism comprises a piston;

said setting tool sealingly engaging said packer body and directing pressure applied therein to move said piston to set said packer;

whereupon application of at least one force in a longitudinal direction to said setting tool, a valve mounted to said packer body is shifted, and said setting tool reengageably releases from said packer body and said valve.

17. A packer-setting assembly for a wellbore, comprising:

a packer having a body which further comprises slips and a sealing element and a setting mechanism;

a setting tool selectively insertable into said packer body for transmission of an hydraulic force therethrough to actuate said setting mechanism on said packer body;

said packer body comprises an actuating piston movable by hydraulic pressure applied through said setting tool; and said packer body comprises a valve, said valve isolating two zones in the wellbore from differential pressures in both directions when in a closed position;

said setting tool is selectively operably engaged to said valve for movement thereof between said closed and an open position.

* * * * *